US005121835A

United States Patent [19]

Grupe

[11] Patent Number: 5,121,835

[45] Date of Patent: Jun. 16, 1992

[54] CANDLE DISPLAY PACKAGE INCLUDING A TRANSPARENT MOLD/CONTAINER

[75] Inventor: Henry W. Grupe, Goshen, Conn.

[73] Assignee: Amwax Ltd., Torrington, Conn.

[21] Appl. No.: 723,818

[22] Filed: Jul. 1, 1991

[51] Int. Cl.[5] ..... B65D 25/00; B65D 73/00

[52] U.S. Cl. ..... 206/45.34; 206/459; 206/806; 206/457; 206/575; 206/461; 206/471; 206/464; 206/470; 425/803

[58] Field of Search ..... 206/45.34, 457, 575, 206/461, 471, 464, 470; 425/803

[56] References Cited

U.S. PATENT DOCUMENTS

| | | | |
|---|---|---|---|
| 3,214,010 | 10/1965 | Sunshine | 206/45.34 |
| 3,298,558 | 1/1967 | Nichol | 206/457 |
| 3,759,478 | 9/1973 | Schmitt et al. | 425/803 X |
| 3,788,590 | 1/1974 | Hasselbach | 425/803 X |
| 3,881,682 | 5/1975 | Kin | 425/803 X |
| 3,907,245 | 9/1975 | Linder | 425/803 X |
| 3,921,801 | 11/1975 | Sway | 206/457 |
| 4,004,773 | 1/1977 | Binder | 425/803 X |
| 4,013,214 | 3/1977 | Hansen et al. | 206/45.34 |

*Primary Examiner*—William I. Price
*Attorney, Agent, or Firm*—Dallett Hoopes

[57] ABSTRACT

A candle is molded in a transparent enclosure which doubles as a retailing container. The enclosure comprises a mold panel having a shaped recess with a sprue passage, and a closure panel. Wick holders may be provided in the enclosure on opposite ends of the recess. The panels may be held together during molding and thereafter by snap-fastener-type elements formed on the panels. The closure panel may have a recess aligned with the recess in the mold panel to make a candle product having a desired contour on both sides. A display graphics card may be held between the panels. In a simpler modification the open transparent mold panel is horizontally disposed without the closure panel. Its recess is fitted with a wick, and wax is poured in and allowed to set. The panel is then secured to a "blister" card.

18 Claims, 4 Drawing Sheets

CANDLE DISPLAY PACKAGE INCLUDING A TRANSPARENT MOLD/CONTAINER

BACKGROUND OF THE INVENTION

1. Field of the Invention

This invention relates to candles. More specifically, this invention relates to a candle display package in which the candle mold enclosure is transparent and doubles as the retailing container for the candle.

2. Description of Related Art including Information Disclosed under §§1.97 to 1.99

In the past candles have been dipped or molded. Dipped candles, of course, have been made by repeatedly dipping the hanging wick into a reservoir of hot wax and letting the wax set. Molded candles, on the other hand, have usually been made in a metal mold wherein the wick has been held centrally in the mold and the wax has been poured about the wick. After the wax is thoroughly set, the mold is opened and the candles have been stripped and wrapped or otherwise packaged for sale.

Decorative molded candles have been made in a mold which has comprised two plastic halves which have provided facing flanges which have been held together by special plates while the pouring is done. Such an apparatus is described in the U.S. Pat. No. 3,788,590 to Hasselbach which issued Jan. 29, 1974.

A glass container has been used to mold a candle as disclosed in Weiss U.S. Pat. No. 3,998,922 which issued Dec. 21, 1976. Candies have been shaped in formed recesses in plastic sheets as disclosed in the Westin U.S. Pat. No. 3,556,022 issued Jan. 11, 1977.

SUMMARY OF THE INVENTION

The present invention is a candle display package comprising a transparent enclosure formed with a shaped recess and a sprue passage. The enclosure comprises two panels, a mold panel having a shaped recess, and a closure panel. The enclosure serves as the mold in the fabrication of the candle. It is provided with wick-holding means. After the candle is poured and set, the enclosure and candle as it is becomes the display package. Thus the term "package" herein is used to indicate the mold enclosure (which, of course, becomes the package container) and the candle therewithin.

BRIEF DESCRIPTION OF THE DRAWINGS

Further objects and features of the invention will be apparent in the following specification and the drawings, all of which disclose a non-limiting embodiment of the invention. In the drawings.

DESCRIPTION OF THE PREFERRED EMBODIMENTS

Figure 2:
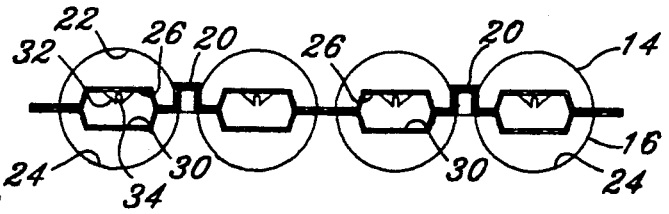
FIG. 2 is an sectional view taken on the line 2—2 of FIG. 1.
Figure 1:
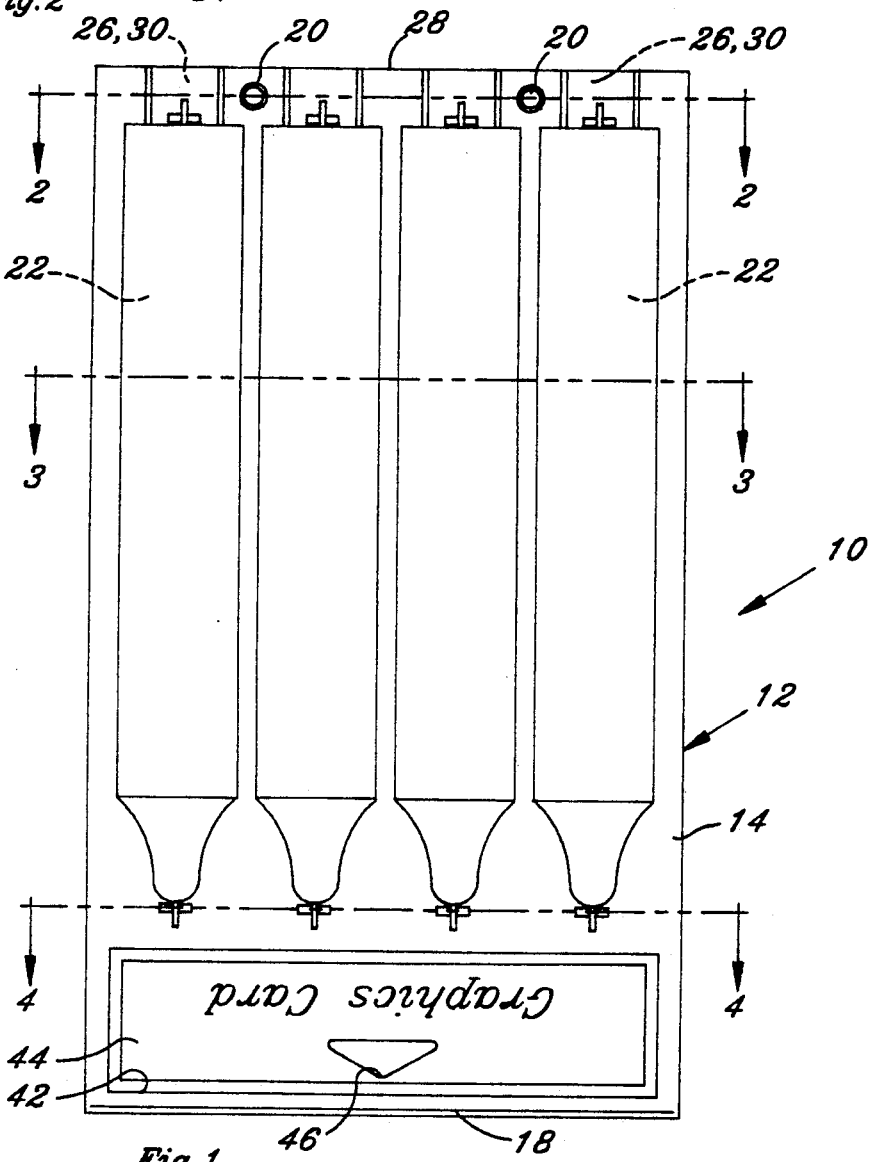
FIG. 1 is a front elevational view of a display package embodying the invention.
Figure 3:
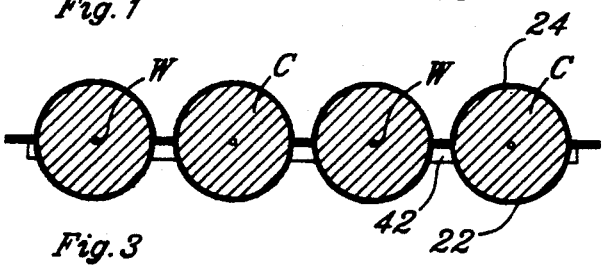
FIG. 3 is a sectional view taken on the line 3—3 of FIG. 1.

A first embodiment of the invention is generally designated 10 in FIG. 1. It comprises a transparent enclosure 12 for a plurality of candles C, including a mold panel 14 against which is mated a closure panel 16. The two panels in this embodiment are very similar. The mold panel 14 and the closure panel 16 are preferably formed from a single molded sheet folded along a hinge line 18, but may be two separate pieces.

The enclosure, as with other embodiments, is made of molded transparent plastic such as polyvinyl chloride, styrene or other material normally used to manufacture what is commonly known as a "blister pack" or thermoformed plastic package.

The mold panel 14 and the closure panel 16 are held in closed mating condition by the hinge 18 and by snap fastener elements comprising a head and socket molded respectively in the panels at suitable locations 20 in the flange which surrounds the recesses. In versions in which there is no hinge, snap fasteners may be used on all sides of the recesses to hold the assembly together.

Mold recesses 22 are formed in the mold panel 14 and comparable mating recesses 24 are formed in the closure panel. A sprue passage 26 is formed in the mold panel extending from one end of each mold recess to the margin 28 of the panel. Comparable mating sprue passages 30 are formed in the closure panel. Together the mold recesses 22 and 24 form the candle mold cavities and the sprue passages 26, 30 form the entire sprue passage.

In each sprue passage the mold panel is provided with an inward projection 32 having a V-shaped notch 34 for holding one end of a candle wick.

At the other ends of the mold cavities wick-holding means are provided and each comprise an inward projection 36 on the mold panel having a V-shaped notch 38 therein. The closure panel is provided with indents 40 which receive the projections 38.

One of the panels 14 or 16 may be provided with a shallow recess above the mold recess 42 into which a graphics card 44 may be inserted. Aligned apertures 46 are provided in the panels and the card to afford an opening for use in hanging the package in a retail environment.

Figure 4A:
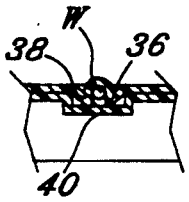
FIG. 4*a* is a fragmentary enlargement of a wick holder shown in FIG. 4.
Figure 4:
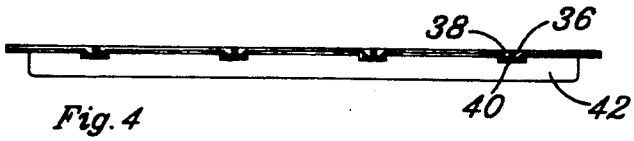
FIG. 4 is a sectional view taken on the line 4—4 of FIG. 1.

In the use of the embodiment described, with the mold panel and the closure panel hinged open about fold line or hinge 18, wicks are installed running taut between the respective wick holders of the respective candle mold panels 22. The panels are then hinged closed along the fold line 18 and the fasteners 20 are snapped shut so that the flanges of the panels surrounding the recesses 22, 24 firmly engage each other. Closing of the panels forces the wick deeper into the V-shaped notches (FIG. 4*a*) to enhance the holding.

The closing may be made more secure by a pair of clamp plates (not shown) used against the outside of the flanges only during the molding operation. The assembly is then disposed with the sprue passages 26, 30 up as in FIG. 1. Molten wax is poured into the sprue passages to fill each of the mold cavities, one after the other or simultaneously.

Once the wax is no longer liquid, the package may be removed from the clamp plates described above and prepared for shipment, the wax slowly cooling completely either during this process or during storage or transport.

At the retailers a candle display package as described may be displayed by hanging it on a hook received through openings 46. The transparent character of the package container makes the candle within clearly visible and facilitates consumer choice. After the purchaser has selected the desired package and taken it home, the package may be opened by pulling apart the mold and closure panels by unsnapping the fasteners 20.

The candles C in each of the cavities 22 during the cooling will have shrunk slightly away from the adjacent walls of the panels so that the candles C may be taken readily out of the enclosure. Cooling within the enclosure and shrinking away from the walls the candles C leave a glossy surface. If the enclosure is made precisely, only faint mold lines appear along the surface of the candles C with no flash. During the unpacking process the wick holders readily yield their grip on the wicks to permit the removal of the candles C from the mold cavities.

DESCRIPTION OF A MODIFICATION

Figure 11:
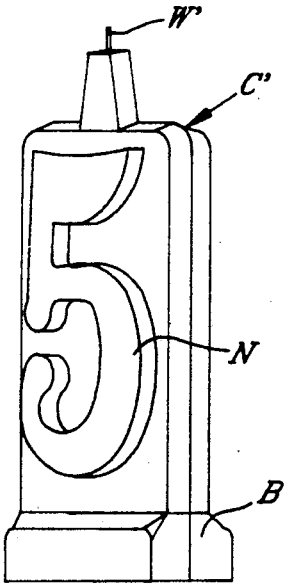
FIG. 11 is a perspective view of a candle product embodying the modified form of the invention.

In the FIG. 5 through 11 embodiment there is produced a rather elaborate birthday numeral candle C' comprising as shown in FIG. 11 a widened base B and a numeral N molded on the flat sides. A wick W' emerges out the top of the product. The product shown in FIG. 11 has been stripped out of the enclosure 112 and is ready for use.

Figure 5:
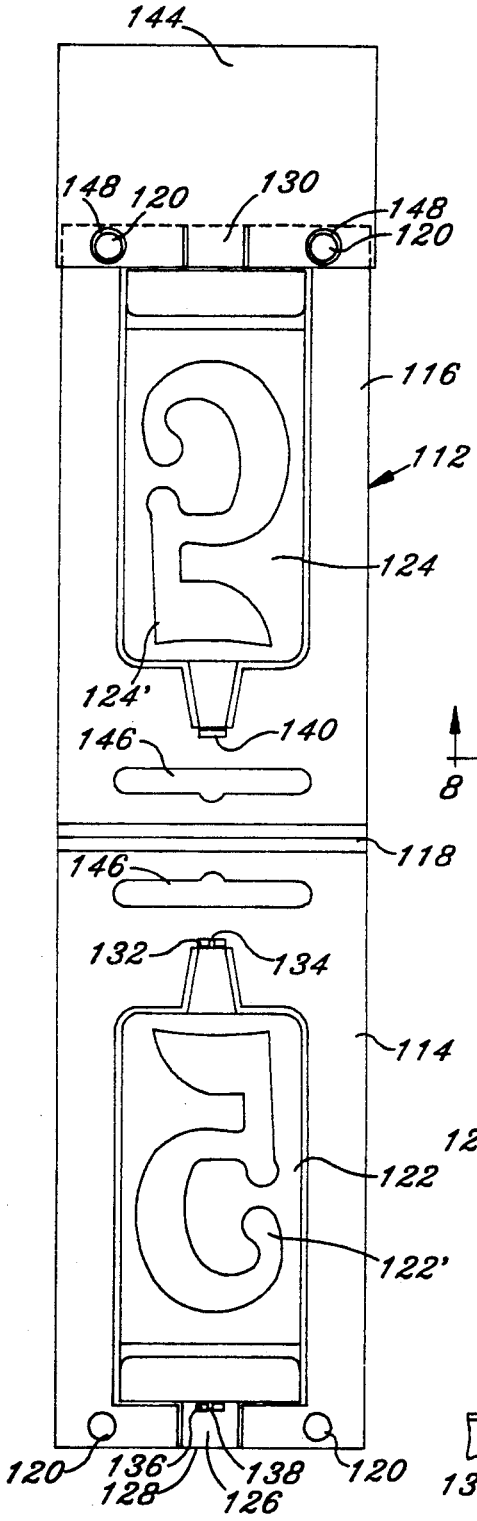
FIG. 5 is a plan view of an enclosure in open condition of a modified form of the invention.
Figure 6:
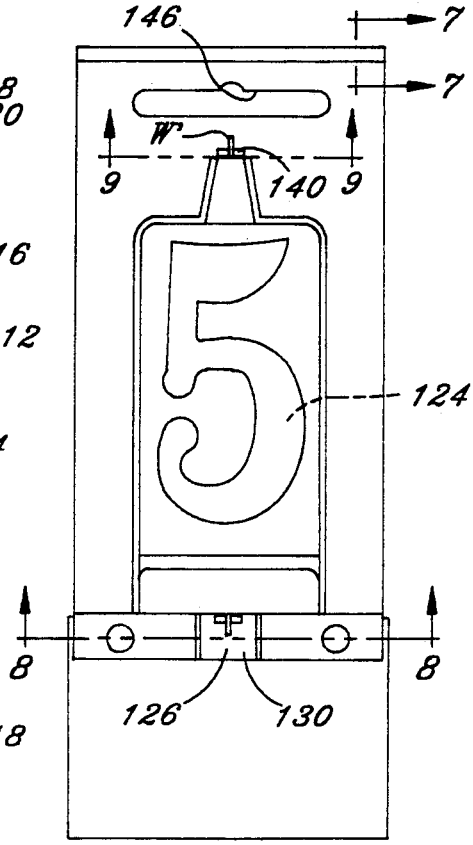
FIG. 6 shows the enclosure of FIG. 5 in closed condition sprue down.
Figure 7:
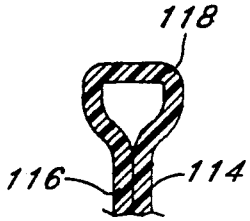
FIG. 7 is an enlarged sectional view taken on the line 7—7 of FIG. 6.
Figure 8:
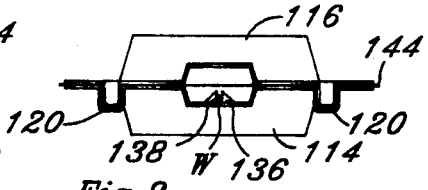
FIG. 8 is a sectional view taken on the line 8—8 of FIG. 6.
Figure 10:
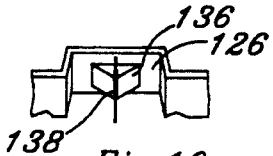
FIG. 10 is a fragmentary perspective view inverted from FIG. 8 showing wick-holding means in the sprue passage of the FIG. 5 through 11 embodiment.

As shown in FIG. 5, the enclosure 112 comprises the mold panel 114 and the closure panel 116. The panels are on a single sheet hinged at 118. The mold panel has a recess 122 and the closure panel also has a recess 124.

The mold panel 114 is formed with a sprue passage 126 which extends from the recess 122 out to the margin 128 of the panel. Similarly, the closure panel 116 is formed with a sprue passage 130 which also extends from the recess 124 out to the margin 128. Cooperant snap fastener elements (heads and sockets) of snap fasteners 120 are disposed opposite the hinge 118 and outward of the recess on the facing flanges of the enclosure.

In the sprue passage 126 in the mold panel 114 an inward projection 136 is formed with a V-shaped or U-shaped notch 138 which serves as a wick holder similar to that of the first embodiment.

Similarly, on the facing flange of the mold panel 114 surrounding the recess 122 an inward projection 132 is provided adjacent the opposite end of the recess 122 from the sprue passage 126. This projection is provided with a V-shaped notch 134. The closure panel adjacent to the opposite end of the recess 124 from the sprue passage 130 is provided with an indent 140.

A graphics card 144 is provided with openings 148 which receive the heads of snap fastener elements 120.

Figure 9:
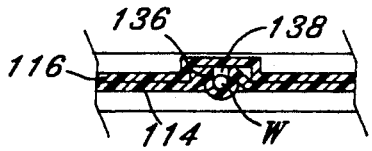
FIG. 9 is an enlarged sectional view taken on the line 9—9 of FIG. 6.

In use and prior to molding, a wick may be pushed into the V-shaped notches of the wick holders 132 and 136 to run tautly therebetween. The panels are then folded closed about the hinge 118 and the snap fastener elements 120 are engaged. In folding the panels 116, 114 about the hinge 118, the detent 140 receives upper wick holder 132 and portion of the panel 116 surrounding the detent 140 pushes the wick deeper into the V-shaped notch 134 (FIG. 9).

The graphics card 144 is sandwiched between the flanges of the two panels adjacent the sprue passages 126 and 130 which together comprise the entryway for wax.

With the enclosure thus closed, the entire unit is placed between two appropriately shaped plates (not shown) to urge together more tightly the flanges of the mold panel 114 and the closure panel 116 to reduce the likelihood of wax seeping between the two panels to create undesirable flash.

With the assembly thus together and the sprue passages 126, 130 pointing upwardly, molten wax may be delivered into the cavity comprising the two recesses 122, 124 and surrounding the wick W'. When the wax has reached a level about even with the bottom of the sprue 126, 130, delivery is stopped and the candle C' is permitted to cool. The display package thus formed may be inverted, placed in storage and shipped to a retailer even before it is completely cooled. At the retailers it may hang on a display rack by the usual wire hook extending through the openings 146 formed in the two panels.

As a variant in the making of the candle using the enclosure 112, wax of a different color from that used in the body of the candle may be injected into the numeral wells 122', 124' with the enclosure open (FIG. 5) and permitted to set. Thereafter the enclosure 112 may be folded closed and the main body of the wax poured through the sprue 126, 130 as described above. The main body of the wax will adhere to the wax in the wells. This gives a two-color candle which heightens the conspicuousness of the numeral on the final product C'. Obviously, additional colors of wax can be used and the design changed. A multicolor Christmas tree is envisioned for a seasonal candle.

DESCRIPTION OF A FURTHER MODIFICATION

Figure 18:
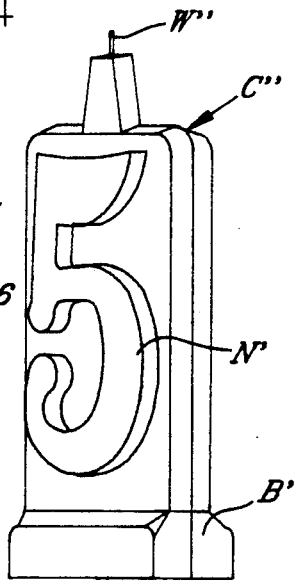
FIG. 18 is a perspective view of a candle product embodying the further modified form of the invention.
Figure 19:
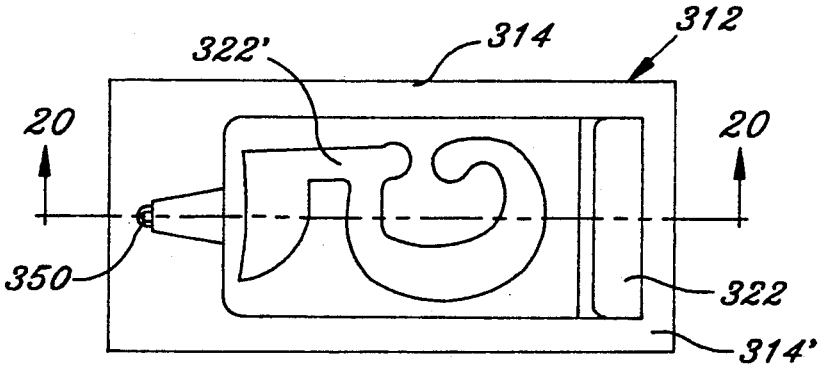
FIG. 19 is a top plan view of a mold enclosure of a still further embodiment of the invention.

In the FIG. 12 through 18 embodiment there is again produced a birthday numeral candle C″ comprising as shown in FIG. 18 a widened base B′ and a numeral N′ molded on the flat sides. A wick W″ emerges out the top of the product. The product shown in FIG. 18 has been stripped out of the enclosure 212 and is ready for use.

Figure 12:
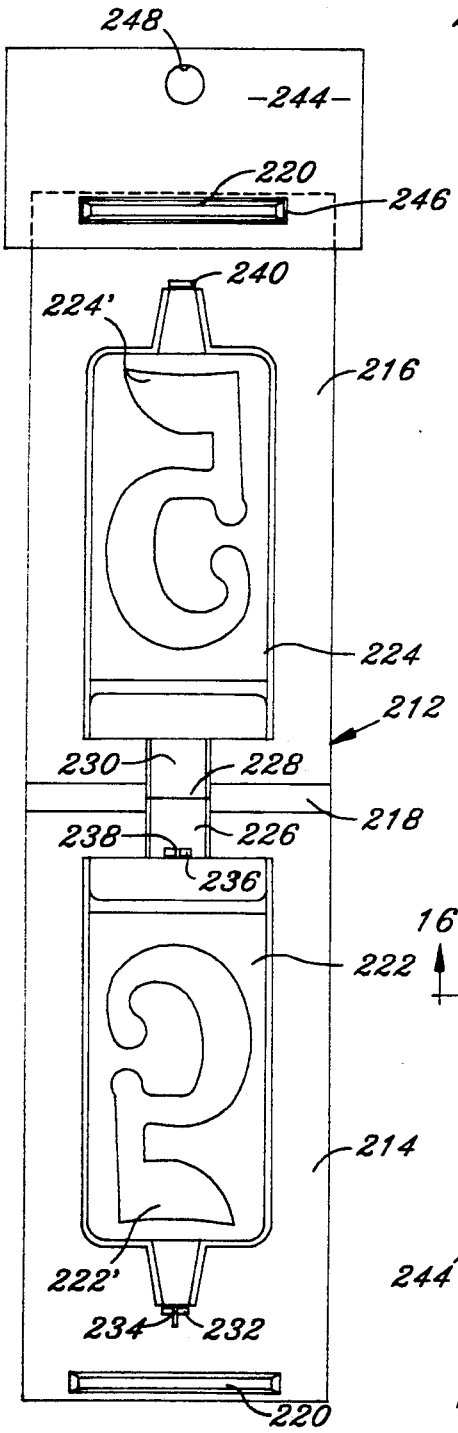
FIG. 12 is a plan view of an enclosure in opened condition of a further modified form of the invention.
Figure 14:
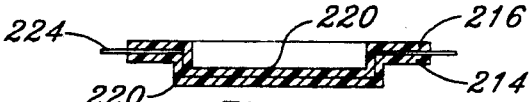
FIG. 14 is an enlarged sectional view taken on the line 14—14 of FIG. 13.

As shown in FIG. 12, the transparent plastic enclosure 212 comprises the mold panel 214 and the closure panel 216. As with the FIG. 5 through 11 embodiment, the panels are on a single sheet hinged at 218. The mold panel has a recess 222 and the closure panel also has a recess 224.

The mold panel 214 is formed with a sprue passage 226 which interrupts the hinge 218 and extends from the recess 222 out to the margin 228 of the panel. Similarly, the closure panel 216 is formed with a sprue passage 230 which also extends from the recess 224 out to the margin 228. Cooperant snap fastener elements (an elongate head and an elongate socket) of a snap fastener 220 are disposed on the flange outward of the recess on the facing flanges of the enclosure.

In the sprue passage 226 in the mold panel 214 an inward projection 236 is provided which has inward in it a V-shaped or U-shaped notch 238 which serves as a wick holder similar to that of the other embodiments.

Similarly, on the facing flange of the mold panel 214 an inward projection 232 is provided adjacent the opposite end of the recess 222 from the sprue passage 226. This projection is provided with a V-shaped notch 234. The closure panel 216 adjacent the opposite end of the recess 224 from the sprue passage 230 is provided with an indent 240.

A graphics card 244 is provided with a slot 246 which receives the elongate head of snap fastener elements 220. The card 244 has a hanging hole 248.

Figure 15:
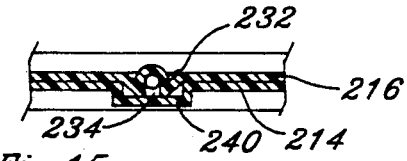
FIG. 15 is an enlarged sectional view taken on the line 15—15 of FIG. 13.
Figure 13:
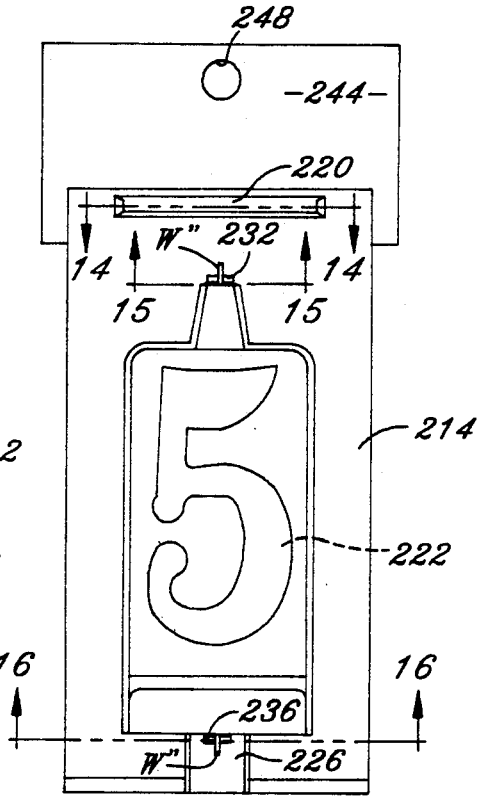
FIG. 13 shows the enclosure of FIG. 12 in closed condition, sprue down.
Figure 16:
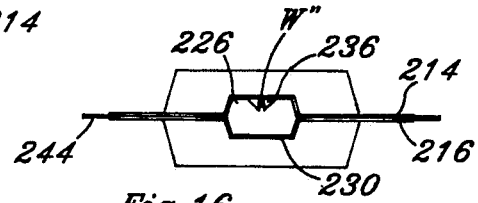
FIG. 16 is a sectional view taken on the line 16—16 of FIG. 13.
Figure 17:
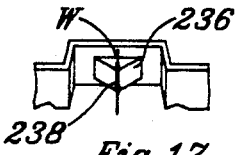
FIG. 17 is a fragmentary perspective view showing wickholding means in the sprue passage of the FIG. 12 through 18 embodiment.

In use and prior to molding, a wick may be placed in the wick holders 232 and 236 to run tautly therebetween. The panels are then folded closed about the hinge 218 and the snap fastener elements 220 are engaged. In folding the panels 216, 214 about the hinge 218, the detent 240 receives upper wick holder 232 and the portion of the panel 216 surrounding the detent 240 pushes the wick deeper into the V-shaped notch 234 (FIG. 15).

The graphics card 244 is sandwiched between the flanges of the two panels opposite the sprue passages 226 and 230 which together comprise the entryway for wax.

With the enclosure thus closed, the entire unit is placed between two appropriately shaped plates (not shown) to urge together more tightly the flanges of the mold panel 214 and the closure panel 216 to reduce the likelihood of wax seeping between the two panels to create undesirable flash.

With the assembly thus together (FIG. 13) and the sprue passages 226, 230 pointing upwardly (inverted from the position shown) wax may be delivered into the cavity comprising the two recesses 222, 224 and surrounding the wick W″. When the wax has reached a level about even with the bottom of the sprue 226, 230 delivery is cut off and the candle C″ is permitted to cool. The display package thus formed may be shipped to a retailer even before it is completely cooled. At the retailers it may hang on a display rack by the usual wire hook extending through the openings 146 formed in the two panels.

As a variant (described above) in the making of the candle using the enclosure 212, wax of a different color or colors from that used in the body of the candle may be injected into the numeral wells 222′, 224′ with the enclosure open (FIG. 12) and permitted to set. Thereafter the enclosure 112 may be folded closed and the main body of the wax poured through the sprue 226, 230 described above. The main body of the wax will adhere to the wax in the wells. This multi-color effect heightens the conspicuousness of the numeral on the final product C″.

A STILL FURTHER EMBODIMENT

A further embodiment of the invention is shown in FIGS. 19 through 22. In this embodiment the mold enclosure 312 comprises the transparent mold panel 314. This panel is formed with a shaped recess 322 which includes, by way of illustration, a numeral well 322′. The recess is provided with shallow narrow enlargement 350 at one end thereof to serve as a wick holder. The extension is shallow so that the wick will be supported well above the lower level of the cavity. As with other embodiments, the recess is surrounded by a flange 314′.

Figure 20:
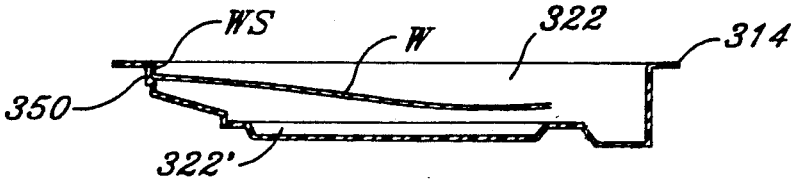
FIG. 20 is a sectional view taken on the line 20—20 of FIG. 19 and showing the wick and poured candle body in the mold enclosure.
Figure 21:
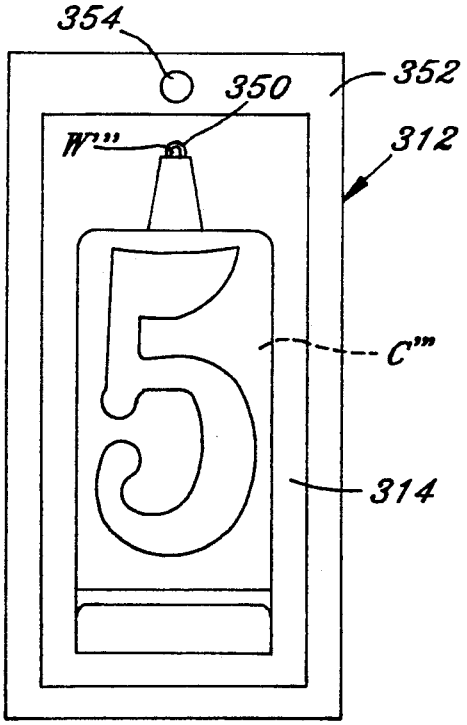
FIG. 21 is a slightly reduced elevational view of the front of a candle display package of the FIG. 19 embodiment.
Figure 22:
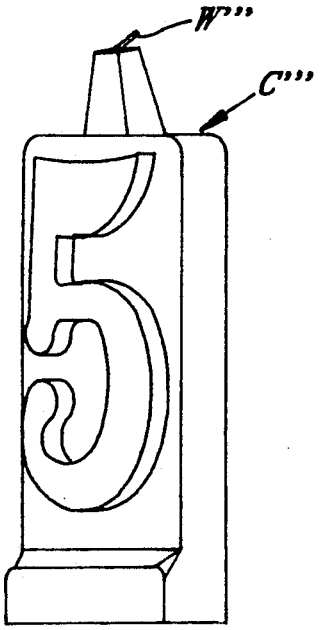
FIG. 22 is an enlarged perspective view showing a candle from which the package container of the FIG. 19 embodiment has been stripped.

As shown in FIG. 20, the wick W‴ may be supported in the shaped recess after the candle has been partially poured. For instance, it may rest at one end on the wax previously poured into the numeral well 322′. Preferably, the wick is bent into an L-shape and the shorter leg WS is pushed into the narrow extension 350. In actual practice, the wick W‴ may be actually in the form of a small cylindrical birthday candle or the like which is set into the recess so that its protruding wick WS is disposed in the narrow enlargement 350, the opposite end of the cylindrical candle resting on the partly poured portion or even a higher portion of the enclosure bottom.

Molten wax is poured into the panel 314 in horizontal disposition to a level slightly below the top thereof. A backing card 352 may be cemented or sealed against the flange 314′ of the enclosure and the card 352 may have suitable graphics thereon. A hanging opening 354 is provided in the card.

When it is desired to use the candle of the FIGS. 19 through 22 embodiment, the card 352 is stripped off the back of the mold panel 314 and the candle C‴ itself is extracted from the mold panel, usually by simply turning the mold panel upside down. As stated, when the candle cools, it shrinks slightly away from the mold enclosure and this makes it readily removable therefrom. The wick W‴, which readily comes out of the extension 350 is accessible at the top of the candle and may be bent straight before lighting, if desired or necessary. It is likely to be covered with a layer of candle wax but not such as to affect the lighting.

In the FIGS. 19 through 22 embodiment there is no sprue passage: the wax is merely poured into the cup-like mold panel shown in FIG. 20. Nor is there any closure panel to serve as part of the mold enclosure. The card 352 is merely attached to the flange of the enclosure 314 after the candle has been molded and the wax is virtually set.

It will be clear from the foregoing descriptions that display packages produced in accordance with the invention offer one distinct advantage: there is no candle handling necessary between mold and package container because the mold is the package container. The arrangement works well: the wax shrinks slightly in cooling, takes on a glossy sheen and is readily removed from the enclosure when the package is opened. Other benefits of the invention are that because the enclosure travels with the candle, the candle may cool during the storage or shipping process: it need not be completely cooled and formed before it leaves the wax-pouring site because the candle does not need to be removed from the mold.

It should be understood that further variations are possible. For instance, in the FIG. 5 through 18 embodiments the closure panel may be simply a flat sheet in the case where a flat candle is desired. The wick holders may be of different form, although the ones described are preferred. The panels may be separate —not hinged together— and held in place by buttons or other orienting means. The graphics information, instead of being on a card, can be printed on one of the panels itself.

Thus, the invention is not limited to the embodiments described but is receptive to reasonable variations. The protection to which the invention is entitled, therefore, is limited only by the scope of the following claim language and such extensions of the right to exclude others from making, using and selling as is appropriate under the doctrine of equivalents.

What is claimed is:

1. A candle display package comprising a transparent plastic mold panel formed with a shaped recess and a sprue passage communicating from one end of the shaped recess to a margin of the mold panel, a closure panel releasably secured against the mold panel to close it, a pair of wick-holding means in the sprue passage and one of the panels at the opposite end of the shaped recess respectively, a wick engaging the pair of wick-holding means and extending tautly therebetween and a molded wax candle body surrounding the wick and disposed snugly in the cavity defined by the recess and the closure panel and conforming in shape thereto.

2. A candle display package as claimed in claim 1 wherein the closure panel is also of transparent plastic and also has a shaped recess which combines with the recess in the mold panel to form a single mold cavity.

3. A candle display package as claimed in claim 1 wherein a sprue passage is also formed in the closure panel and combines with the sprue passage in the mold panel to form a single sprue passage.

4. A candle display package as claimed in claim 1 wherein the mold panel and the closure panel are parts of a single sheet of transparent plastic hinged between the panels.

5. A candle display package as claimed in claim 1 wherein the mold panel and the closure panel are releasably secured together by at least one snap-fastener-type fastener having cooperant components in the panels respectively outside the margins of the cavity.

6. A candle display package as claimed in claim 1 wherein a graphics card is disposed at least in part between the closure panel and the mold panel.

7. A candle display package as claimed in claim 6 wherein the mold panel and the closure panel are releasably secured together by at least one snap-fastener-type fastener having cooperant components in the panels respectively outside the margins of the cavity and the card is apertured and the aperture receives a part of a snap-fastener-type component to secure the card against lateral displacement.

8. A candle display package as claimed in claim 1 wherein the wick-holding means in the sprue passage is an inward projection having V-shaped notch therein.

9. A candle display package as claimed in claim 1 wherein the wick-holding means in said one of the panels at the other end of the shaped recess is an inward projection having a V-shaped notch in it and the closure panel has an indent to accommodate the last-mentioned projection.

10. A candle display package as claimed in claim 1 wherein the mold panel and the closure panel are apertured in alignment to provide a hanging opening whereby the package may be hung in a retail display environment.

11. A candle display package comprising a transparent plastic mold panel formed with a shaped recess and a surrounding flange, the recess having a main cavity and a wick-holding lateral narrow extension at the center of one end thereof, the extension being shallower than the main cavity, a closure panel secured against the flange of the mold panel, a wick disposed above the bottom of the cavity and into the lateral narrow extension and a molded wax candle body surrounding the wick and disposed snugly in the recess and conforming in shape thereto.

12. A candle display package as claimed in claim 11 wherein the closure panel is apertured to provide a hanging opening whereby the package may be hung in a retail display environment.

13. A candle display package as claimed in claim 11 wherein the wax is of more than one color.

14. A candle display package comprising a transparent plastic mold panel formed with a shaped recess and a sprue passage communicating from one end of the shaped recess to a margin of the mold panel, a closure panel releasably secured against the mold panel to close it, wick-holding means in the sprue passage, a wick engaging the wick-holding means and extending into the recess and a molded wax candle body surrounding the wick and disposed snugly in the cavity defined by the recess and the closure panel and conforming in shape thereto.

15. A candle display package as claimed in claim 14 wherein the closure panel is also of transparent plastic and also has a shaped recess which combines with the recess in the mold panel to form a single mold cavity.

16. A candle display package as claimed in claim 14 wherein a sprue passage is also formed in the closure panel and combines with the sprue passage in the mold panel to form a single sprue passage.

17. A candle display package as claimed in claim 14 wherein the mold panel and the closure panel are parts of a single sheet of transparent plastic hinged between the panels.

18. A candle display package as claimed in claim 14 wherein the mold panel and the closure panel are releasably secured together by at least one snap-fastener-type fastener having cooperant components in the panels respectively outside the margins of the cavity.

* * * * *